US005890619A

United States Patent [19]

Belanger

[11] Patent Number: 5,890,619

[45] Date of Patent: Apr. 6, 1999

[54] SPILL-PROOF DRINKING CONTAINER

[76] Inventor: Richard A. Belanger, 16 Lamprey Rd., Kensington, N.H. 03827

[21] Appl. No.: 858,025

[22] Filed: May 16, 1997

[51] Int. Cl.[6] ..... A47G 19/22

[52] U.S. Cl. ..... 220/713; 220/714; 220/718; 222/485; 222/490

[58] Field of Search ..... 220/230.02, 203.11, 220/203.15, 203.16, 203.17, 203.18, 203.19, 254, 255, 367.1, 231, 373, 703, 704, 705, 711, 713, 714, 716, 717, 718; 215/260, 11.4, 11.5, 262, 270, 307, 309, 310, 311, 387–389; 222/481.5, 490, 485, 478

[56] References Cited

U.S. PATENT DOCUMENTS

| | | | |
|---|---|---|---|
| 2,534,614 | 12/1950 | Michael | 220/713 |
| 2,623,368 | 12/1952 | Olsen | 220/711 |
| 4,133,457 | 1/1979 | Klassen | 222/490 X |
| 5,079,013 | 1/1992 | Belanger | 215/11.4 X |
| 5,542,670 | 8/1996 | Morano | 220/714 |
| 5,553,726 | 9/1996 | Park | 215/11.4 |
| 5,706,973 | 1/1998 | Robbins, III et al. | 220/714 |

FOREIGN PATENT DOCUMENTS

| | | | |
|---|---|---|---|
| 93/19718 | 10/1993 | WIPO | 220/714 |

*Primary Examiner*—Stephen K. Cronin
*Assistant Examiner*—Nathan Newhouse
*Attorney, Agent, or Firm*—Frederick R. Cantor, Esq.

[57] ABSTRACT

A spill-proof covered drinking container has an annular protruding drinking spout that provides a relatively large number of separate drinking ports around the spout circumference. An annular suction-responsive valve means is located within the drinking spout for controlling outflow of liquid through the drinking ports, such that liquid flow is confined to the port, or ports, in physical contact with the user's mouth. The user can drink from any point around the spout circumference.

8 Claims, 2 Drawing Sheets

SPILL-PROOF DRINKING CONTAINER

BACKGROUND AND SUMMARY OF THE PRESENT INVENTION

This invention relates to a spill-proof drinking container, and particularly to a covered spill-proof container wherein the person's mouth can be applied to any point around the circumference of the container cover.

My issued U.S. Pat. No. 5,079,013 discloses a dripless covered container having a drinking spout that contains a liquid outlet control valve. The control valve automatically closes when the container is overturned or otherwise tips over. When a person's mouth exerts a suction force to the drinking spout the control valve automatically opens to enable the person to withdraw liquid from the container. The person can drink from the covered container in various tilted positions of the container as long as the control valve is in contact with the liquid.

The dripless covered container shown in my issued U.S. Pat. No. 5,079,013 has a drinking spout offset from the container cover central axis. The person using the container is required to hold the container in a position wherein the spout is generally below the level of the liquid in the container. When the container is in a near-empty condition the container has to be tilted downwardly so that the spout is pointed in a downward direction, as shown in FIG. 2 of the patent drawing; otherwise the control valve will not be in contact with the container liquid.

The present invention is concerned with a covered dripless container that can be held in a range of different positions, while still permitting the person to consume liquid from the container. The container has an annular drinking spout having plural drinking ports spaced around the periphery of the container cover, whereby the person can apply his/her mouth to any point along the drinking spout.

The invention enables the person to grip the container at any point on the container side wall; it is not necessary to orient the hand grip in any special relationship to the drinking spout. All that is required is to lift the container to one's mouth and tilt the container sufficiently to cause the container liquid to flow into the area of the annular drinking spout in contact with the mouth. Drinking ports in contact with the person's mouth convey the liquid from the container into the person's mouth.

The covered container can be used as a dripless training cup by infants or young children. However, the container has other uses, e.g. as a container for coffee, soft drinks or other beverages that one might wish to consume while in a moving truck, automobile, or mobile home, where a conventional drinking container might tend to spill or overflow. Invalid persons, or persons not having complete control of their hands or mouth areas, would find the container of the present invention especially useful, due to its spill-proof character and its relatively easy method of use.

The invention contemplates a dripless covered container having an annular drinking spout that allows the user to drink from any circumferential location on the spout. Evenly-spaced drinking ports along the spout facilitate the desired drinking procedure. The container cover is preferably a molded component formed out of any suitable plastic material, e.g. a polyolefin. An annular suction-responsive control valve within the annular drinking spout can be molded, or otherwise formed, out of various elastomers, e.g. silicone rubber.

The annular suction-responsive control valve within the drinking spout preferably comprises an elastomeric molded ring structure having a hollow "V"-shaped cross-section. This annular valve ring is provided with a series of evenly spaced circumferential slits formed in the apex surface of the "V"-shaped elastomeric wall structure so as to be aligned with the drinking ports in the associated drinking spout; the walls of the "V"-shaped wall structure are flexible so as to be responsive to vacuum forces. The annular drinking spout has a number of internal partitions interposed between the various drinking ports so as to form a number of separate internal vacuum chambers, one chamber for each drinking port.

These internal partitions abut the apex area of the elastomeric "V"-shaped wall structure, such that each slit in the apex area of the elastomeric wall is potentially exposed to a vacuum force generated by the person's mouth on the aligned area of the annular drinking spout. The aforementioned partitions form individual vacuum chambers between individual drinking ports and individual aligned slits in the elastomeric valve ring, whereby the vacuum force is directed or localized to a particular slit. Any slit exposed to the vacuum force will be opened for transporting liquid from the container through the aligned drinking port in the annular drinking spout into the person's mouth.

Typically, the annular drinking spout will comprise a hollow "V" cross-sectioned wall structure having two convergent annular walls and a bridging wall at the point of convergence of the convergent walls. The drinking ports will be located on a circumferential line running along the bridging wall. Typically, there will be approximately sixteen to twenty drinking ports evenly spaced along the circumferential dimension of the bridging wall. Each drinking port can be a small rectangular hole having a length cross-sectional dimension of about 0.20 inch, and a width cross-sectional dimension of about 0.02 inch. The port cross-sectional dimension is small enough so as to achieve a pressure differential across the individual port.

The pressure differential achieved across the individual drinking port is designed to minimize drippage out of the drinking spout when the person ceases to exert a suction force on any one of the drinking ports. Residual liquid in any one of the vacuum chambers in the drinking spout tends to remain in the chamber, rather than leaking out through the drinking port.

The invention provides an improved covered dripless drinking container that can be readily and conveniently used in various attitudes or positions. The person can grip the container in one hand and put the container up to his mouth so that any point on the annular drinking spout is engaged with the mouth. The user can withdraw liquid from the container at any point along the annular drinking spout.

Specific advantages and features of the invention will be apparent from the attached drawings and description of an illustrative embodiment of the invention.

DESCRIPTION OF THE PREFERRED EMBODIMENTS OF THE PRESENT INVENTION

Figure 1:
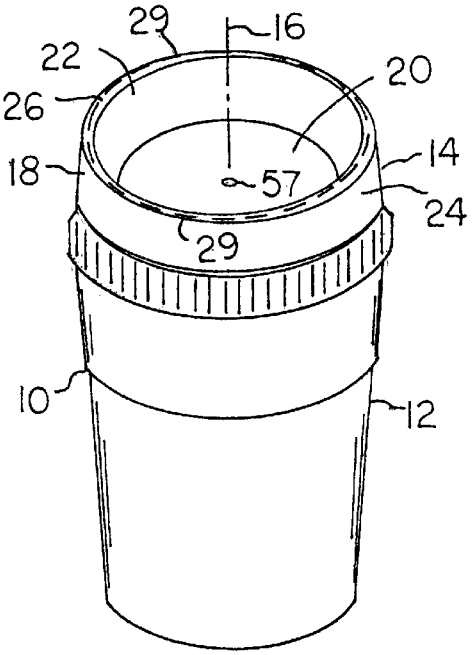
FIG. 1, is a perspective view, of a covered dripless container embodying the invention.

FIG. 1, is a perspective view, of a covered dripless container embodying the invention.

Referring to FIG. 1, there is shown a covered dripless drink container 10 embodying the invention. The container assembly comprises a generally cylindrical (or frusto-conical) container body 12 having an external thread extending around and along its upper edge. A mating circular cover 14 has a downturned annular peripheral lip having an internal screw thread adapted for screw-on attachment on the container body thread, whereby the cover can be releasably secured to the container body or removed from the container body. Cover 14 is preferably a one piece molded component, formed e.g. from a rigid plastic material, such as polyolefin. The container body can be formed of a similar material.

The molded circular cover 14 has a central axis 16 and an annular hollow drinking spout 18 centered on said central axis so as to protrude upwardly from the plane of a central circular disk area 20. Annular drinking spout 18 has a hollow "V" cross-section defined by two concentric annular walls 22 and 24 convergent in an upward direction, and an annular bridge wall 26 connected to said convergent walls at the point of convergence. Bridge wall 26 has a curved external surface 27 having a relatively small radius of curvature, whereby the drinking spout surface 27 can fit comfortably within a person's mouth.

The person can apply his/her mouth to any point around, or along, bridge wall 26. The covered container can be used for drinking purposes by lifting the container to the person's mouth, and tilting the container to allow liquid within the container to flow gravitationally toward the low point of the annular drinking spout, i.e. the portion of the drinking spout within the person's mouth.

The covered container can be used for drinking purposes by various persons, including infants, small children, adults, persons having hand coordination problems (e.g. Parkinson's disease), and blind persons. The covered container has a dripless character that enables the container to be tilted or overturned without causing the container liquid to spill out of the container. The container liquid is drawn out of the container by suction (sucking) forces applied to the drinking spout via the user's mouth. As noted above, the person can apply his/her mouth to the drinking spout at any point along the spout circumference.

Plural drinking ports 29 are formed in bridge wall 26 at spaced points around the drinking spout circumference. The drinking ports are preferably evenly spaced, although some variation in port spacing can be utilized, if desired, while still practicing the invention. Typically, there are approximately sixteen to twenty drinking ports in bridge wall 26. Each drinking port can be a rectangular slot-like opening having a cross-sectional width of about 0.02 inch and a cross-sectional length of about 0.20 inch. In an alternative arrangement, each drinking port can be a row of small circular holes having a combined cross-sectional area equivalent to the described single rectangular opening.

Figure 2:
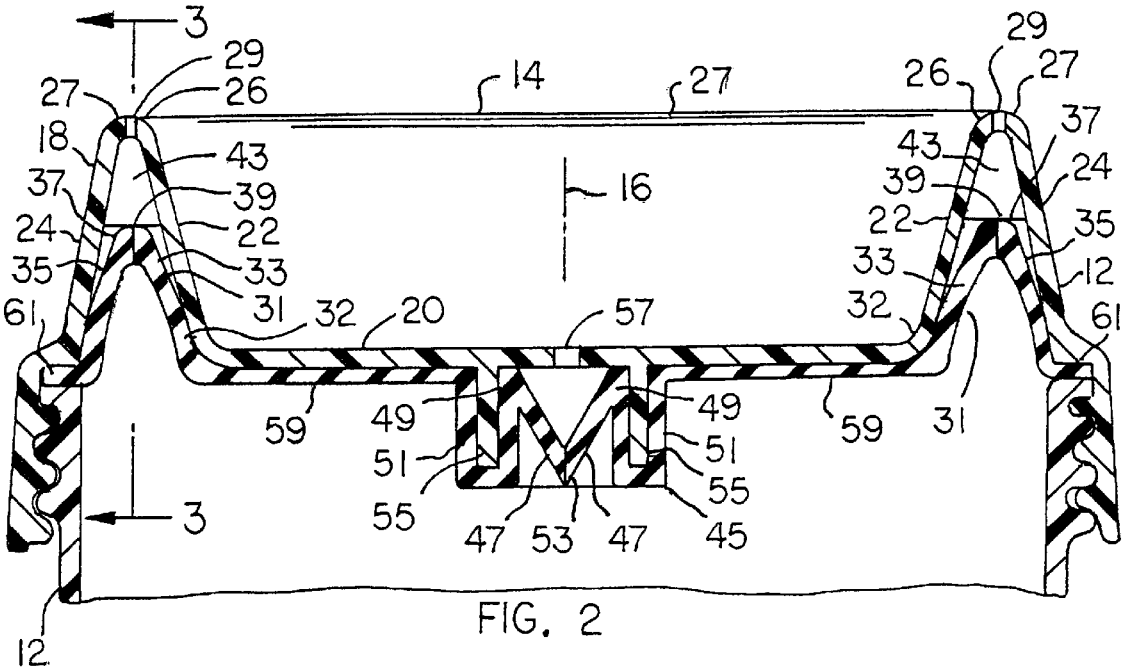
FIG. 2, is an enlarged cross-sectional view, taken through the cover of the FIG. 1 container.
Figure 5:
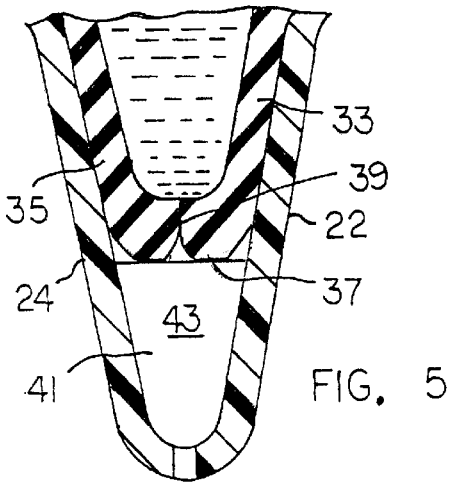
FIG. 5, is a fragmentary enlarged sectional view, taken in the same direction as FIG. 2, but showing the cover in an inverted position.

FIG. 5, is a fragmentary enlarged sectional view, taken in the same direction as FIG. 2, but showing the cover in an inverted position.

The drinking port cross-sectional dimension is kept relatively small in order to prevent leakage of residual liquid from suction chambers 43 through ports 29 of the drinking spout in the event the cover is overturned, as depicted e.g. in FIG. 5. The small size drinking port 29 exerts a pressure drop on any liquid tending to flow out of the drinking spout through any one of ports 29. If the required pressure drop is greater than gravitational forces that would produce outflow through ports 29, the resistance to flow will be sufficient to prevent drippage (flow) through ports 29, in the absence of a suction force by the user's mouth.

FIG. 2, is an enlarged cross-sectional view, taken through the cover of the FIG. 1 container.

An annular suction-responsive valve means 31 is located within the annular drinking spout 18 for controlling the flow of container liquid out of drinking ports 29. As shown in the drawings, the suction-responsive valve means comprises an annular elastomeric membrane 32 having a "V" cross-section. The cross-section is the same at all locations around the drinking spout circumference.

Figure 3:
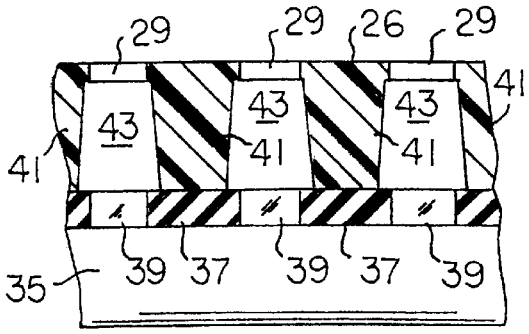
FIG. 3, is a fragmentary cross-sectional view, taken on line 3—3 in FIG. 2.

FIG. 3, is a fragmentary cross-sectional view, taken on line 3—3 in FIG. 2.

Figure 4:
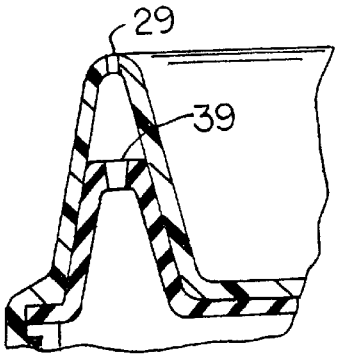
FIG. 4, is a fragmentary cross-sectional view, taken in the same direction as FIG. 2, but showing a suction-responsive control valve in an open condition.

FIG. 4, is a fragmentary cross-sectional view, taken in the same direction as FIG. 2, but showing a suction-responsive control valve in an open condition.

The annular elastomeric membrane comprises two opposed convergent annular walls 33 and 35, and an interconnecting apex wall 37. Plural slits 39 are cut through apex wall 37 so as to be aligned with individual ones of the drinking ports 29. Each one of the slits is aligned with a drinking port 29, so that the number of slits corresponds with the number of drinking ports, e.g. sixteen slits for sixteen drinking ports. In the absence of a suction force applied through a drinking port 29, each slit 39 will be in a closed condition, as shown in FIG. 2. Upon the application of a suction force to any given slit 39, the slit will open to approximately the condition depicted in FIG. 4. As shown best in FIG. 3, the length of each slit 39 is approximately the same as the length of each aligned drinking port 29.

The rigid annular drinking spout 18 has plural internal partitions (or ribs) 41 extending from bridge wall 26 so as to abut the apex wall 37 of elastomeric membrane 32. The number of partitions 41 corresponds to the number of drinking ports 29. For example, a drinking spout structure 18 having sixteen drinking ports 29 will also have sixteen partitions 41. The partitions are located between neighboring ports 29 so that each port 29 communicates with a separate suction cell (or chamber) 43 formed by two neighboring partitions.

As best shown in FIG. 3, each suction chamber 43 forms a passage between one drinking port 29 and an aligned openable slit 39. A suction force exerted by a person's mouth through one of drinking ports 29 will be transmitted through the associated suction chamber 43 to the aligned slit 39, thereby pulling the membrane walls 33 and 35 apart so as to open the affected slit. Partitions 41 localize or confine the suction force to a particular suction chamber. The suction force is effective on the aligned portion of the elastomeric membrane, rather than being dissipated between multiple membrane surfaces.

It will be seen from FIG. 2 that the outer surfaces of membrane walls 33 and 35 are spaced from the inner surfaces of drinking spout walls 22 and 24, such that the suction force in a chamber 43 acts on the associated walls 33 and 35 to effect an outward hinging motion of walls 33 and 35, i.e. an opening of slit 39. The pressure differential across the slit causes the slit to open. In the absence of a suction force in chamber 43, the membrane walls 33 and 35 assume the slit-closed condition depicted in FIG. 2.

FIG. 5, is a fragmentary enlarged sectional view, taken in the same direction as FIG. 2, but showing the cover in an inverted position.

The container of this invention is intended to be dripless or leak-free, e.g. when the container tips over or is otherwise in an inverted condition. FIG. 5 fragmentarily shows the cover 14 in an inverted condition. Liquid in the container exerts force on the inner surfaces of membrane walls 33 and 35, such that walls 33 and 35 tend to seat against the inner surfaces of drinking spout walls 22 and 24. Partition 41 forms an abutment surface, preventing the apex wall 37 from deflecting downwardly to a slit-open condition. Edge areas of slit 39 tend to have increased pressure contact so as to form a good seal in spite of the increased pressure of the liquid on the inner surfaces of membrane walls 33 and 35.

Referring momentarily to FIGS. 1 and 2, during continued usage of the covered container the liquid level in container body 12 will progressively fall, due to consumption of the liquid; the enclosed space above the liquid will tend to fall below atmospheric pressure, thereby hindering outflow through the drinking ports 29. In order to prevent a vacuum condition within the container body, there is provided a pressure-responsive valve means 45 (FIG. 2). This valve means comprises an openable elastomeric envelope, or pouch, that includes two opposed deflectable flaps 47 having hinge connections 49 with support channels 51. The free edges of flaps 47 form a slit 53.

Cover 14 comprises two flat spade-like walls 55 located equidistant from a centrally located air hole 57. The elastomeric pressure-responsive valve means 45 has a friction grip on flat walls 55, such that flaps 47 normally seal against air flow into or out of the space below cover 14. However, if the pressure in the container body should drop below the prevailing atmospheric pressure the two flaps 47 will spread apart slightly, due to the pressure differential, thereby opening slit 53. Air will flow through the slit to equalize the pressure.

In the FIG. 2 arrangement the pressure-responsive valve means 45 and the annular elastomeric membrane 32 are integrally connected together by a flat sheet-like connector wall 59 extending along the disk area 20 of cover 14. Preferably membrane 32, connector wall 59 and pressure-responsive valve means 45 are integral parts of a single molded elastomeric member that is removably attached to cover 14. Spade walls 55 fit into the elastomeric channels 51 to support the pressure-responsive valve means 45, while the annular drinking spout 18 frictionally grips outer surfaces of membrane walls 33 and 35 to retain the suction-responsive valve means 31 in an operative position. The elastomeric member can be removed from cover 14 for cleaning purposes.

The peripheral edge area of the elastomeric member can be configured as an annular flange 61 adapted to act as an edge seal between cover 14 and container body 12. This arrangement eliminates the need for a separate seal between the cover and the container body.

Figure 6:
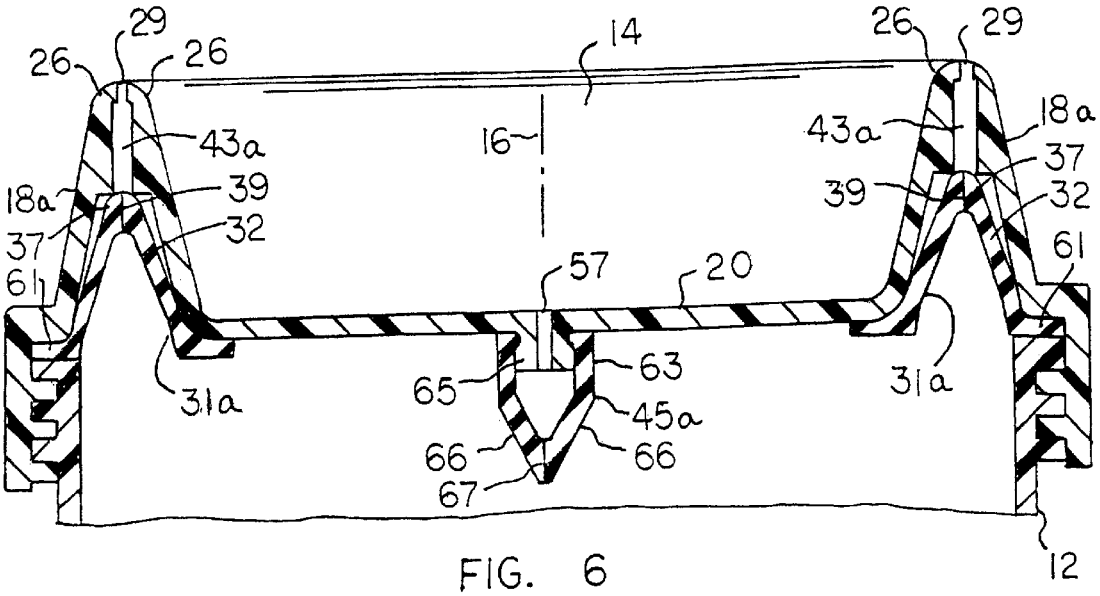
FIG. 6, is a cross-sectional view, taken in the same direction as FIG. 2, but illustrating another embodiment of the invention.

FIG. 6, is a cross-sectional view, taken in the same direction as FIG. 2, but illustrating another embodiment of the invention.

FIG. 6, shows a second form that the invention can take. In this case the suction-responsive valve means 31*a* is formed separately from the pressure-responsive valve means 45*a*. The pressure-responsive valve means comprises an elastomeric sock element 63 having a telescopic fit on a rectangular boss 65 that extends downwardly from cover 14. The opposed walls 66 of the elastomeric sock element form a slit 67 that is openable when the pressure within the container body drops below the prevailing atmospheric pressure.

The annular elastomeric membrane 32 is constructed similarly to the annular membrane depicted in FIGS. 2 and 4. The annular drinking spout 18*a* of FIG. 6 is slightly modified, so that each suction chamber 43*a* is formed by a rectangular cross-section hole or passage formed in the bridge wall 26. The bridge wall material surrounding each suction chamber 43*a* forms a partition structure that isolates the neighboring suction chambers. Each suction chamber 43*a* is aligned with a slit 39 in the apex wall 37 of the elastomeric membrane 32.

Functionally, the FIG. 6 arrangement operates in the same fashion as the FIG. 2 arrangement. In both cases the user can apply mouth suction force at any point around the drinking spout circumference. The covered container, in each case, has a dripless character.

The present invention, described above, relates to a spill-proof drinking container. Features of the present invention are recited in the appended claims. The drawings contained herein necessarily depict structural features and embodiments of the spill-proof drinking container, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed:

1. A spill-proof drinking container comprising:

a container body and an openable cover closing said container body;

said cover having a circular plan configuration centered on a central cover axis;

said cover comprising a central disk area and a hollow annular drinking spout surrounding said disk area;

said annular drinking spout having a hollow "V" cross-section that includes two rigid annular convergent walls and an interconnecting annular bridge wall having a convexly curved outer surface, and plural drinking ports extending through said bridge wall;

said drinking ports being evenly spaced along said annular drinking spout so that a person can drink from any point around the cover circumference;

and suction-responsive valve means located within said annular drinking spout for controlling liquid outflow through said drinking ports;

said suction-responsive valve means comprising an annular elastomeric membrane having a "V" cross-section; said membrane including two rigid convergent walls and an interconnecting apex wall portion, and plural openable slits in said apex wall portion aligned with the drinking ports in said annular drinking spout;

said annular drinking spout having plural internal partitions abutting the apex wall portion of said elastomeric membrane; and said partitions being spaced so that each drinking port and aligned openable slit is isolated from the neighboring ports and aligned slits.

2. The spill-proof drinking container, as described in claim 1, and further comprising a pressure-responsive valve means mounted on the central disk area of said cover for admitting air into the container body when the pressure in said container body is less than the external atmospheric pressure.

3. The spill-proof drinking container, as described in claim 2, wherein said pressure-responsive valve means is formed of an elastomeric material; and elastomeric sheet-like connector means integrally joining said elastomeric membrane and said pressure-responsive valve means.

4. The spill-proof drinking container, as described in claim 3, wherein said elastomeric membrane and said integrally joined elastomeric pressure-responsive valve means constitute a single elastomeric member removably attached to said cover, whereby said single elastomeric member is removable from the cover for cleaning purposes.

5. A spill-proof drinking container comprising:

a container body and an openable cover closing said container body;

said cover having an annular drinking spout extending therearound;

said annular drinking spout having a number of spaced drinking ports;

suction-responsive valve means located within said annular drinking spout for controlling flow through said drinking ports;

said suction-responsive valve means comprising an annular elastomeric membrane having plural openable slits aligned with individual ones of said drinking ports; and said annular drinking spout having a plural number of internal partitions abutting said elastomeric membrane to isolate individual ones of the drinking ports.

6. A spill-proof drinking container comprising:

a container body and an openable cover closing said container body;

said cover having a central axis;

said cover having an annular drinking spout extending therearound;

said annular drinking spout having a number of spaced drinking ports;

suction-responsive valve means located within said annular drinking spout for controlling flow through said drinking ports;

said annular drinking spout comprising a hollow "V" cross-section wall structure, concentric around said central axis;

said suction-responsive valve means comprising an elastomeric annular membrane having a "V" cross-section fitting within said drinking spout;

said annular membrane having two convergent opposed walls and an interconnecting apex wall portion, and plural openable slits in said apex wall portion aligned with the drinking ports in said annular drinking spout;

said hollow "V" cross-section drinking spout wall structure comprising two rigid convergent walls and an interconnecting bridge wall having a convexly curved outer surface;

said drinking ports being formed in said bridge wall; and said annular drinking spout having a series of internal partitions abutting the apex wall portion of said elastomeric membrane to isolate adjacent drinking ports.

7. A spill-proof drinking container comprising;

a container body and an openable cover closing said container body;

said cover having a central axis;

said cover having an annular drinking spout extending therearound;

said annular drinking spout having a number of spaced drinking ports;

suction-responsive valve means located within said annular drinking spout for controlling flow through said drinking ports;

said annular drinking spout comprising a hollow "V" cross-section wall structure concentric around said central axis;

said suction-responsive valve means comprising an elastomeric annular membrane having a "V" cross-section fitting within said drinking spout;

said annular membrane having two convergent opposed walls and an interconnecting apex wall portion having plural openable slits, a number of said slits being equal to the number of space drinking ports, each of said plural openable slits in said apex wall portion axially aligned with each of said drinking ports in said annular drinking spout;

said hollow "V" cross-section drinking spout wall structure comprising two rigid convergent walls and an interconnecting bridge wall having a convexly carved outer surface;

said drinking ports being formed in said bridge wall; and the convergent walls of said spout wall structure being spaced apart to limit the opening movements of said convergent opposed membrane walls when a suction force is applied to the associated drinking ports.

8. A spill-proof drinking container comprising;

a container body and an openable cover closing said container body;

said cover having an annular drinking spout extending therearound;

said drinking spout having a number of spaced drinking ports;

suction-responsive valve means located within said annular drinking spout for controlling flow through said drinking ports; and said suction-responsive valve means comprising an annular elastomeric membrane having plural openable slits, a number of said slits being equal to number of spaced drinking ports, each of said slits axially aligned with each of said drinking ports.

* * * * *